US009704507B2

(12) United States Patent
Westerman

(10) Patent No.: US 9,704,507 B2
(45) Date of Patent: Jul. 11, 2017

(54) METHODS AND SYSTEMS FOR DECREASING LATENCY OF CONTENT RECOGNITION

(71) Applicant: Ensequence, Inc., Portland, OR (US)

(72) Inventor: Larry Alan Westerman, Portland, OR (US)

(73) Assignee: Ensequence, Inc., Portland, OR (US)

( * ) Notice: Subject to any disclaimer, the term of this patent is extended or adjusted under 35 U.S.C. 154(b) by 73 days.

(21) Appl. No.: 14/530,586

(22) Filed: Oct. 31, 2014

(65) Prior Publication Data

US 2016/0125889 A1 May 5, 2016

(51) Int. Cl.
*G10L 21/00* (2013.01)
*G10L 25/51* (2013.01)

(52) U.S. Cl.
CPC ..... *G10L 25/51* (2013.01)

(58) Field of Classification Search
CPC ..... G10L 21/00; G10L 21/0208
USPC ..... 704/270, 226, 233
See application file for complete search history.

(56) References Cited

U.S. PATENT DOCUMENTS 6,968,337 B2 11/2005 Wold
7,529,659 B2 5/2009 Wold
7,877,438 B2 1/2011 Schrempp et al.
7,881,931 B2 2/2011 Wells et al.
8,082,150 B2 12/2011 Wold
8,112,818 B2 2/2012 Wold
8,140,331 B2 3/2012 Lou
8,489,884 B2 7/2013 Srinivasan
8,571,864 B2 10/2013 DeBusk et al.
2002/0064139 A1* 5/2002 Bist ..... H04B 3/23 370/289
2002/0076034 A1* 6/2002 Prabhu ..... H04Q 1/46 379/390.02
2002/0116186 A1* 8/2002 Strauss ..... G10L 25/78 704/233
2003/0105637 A1* 6/2003 Rodriguez ..... G06F 17/2735 704/270
2006/0149533 A1 7/2006 Bogdanov
2006/0149552 A1 7/2006 Bogdanov
2007/0127717 A1 6/2007 Herre et al.
2013/0044885 A1 2/2013 Master et al.
2013/0165734 A1* 6/2013 Butters ..... A61N 2/002 600/13
2013/0226957 A1 8/2013 Ellis et al.
2013/0259211 A1* 10/2013 Vlack ..... G06F 17/30743 379/88.01
2014/0119551 A1* 5/2014 Bharitkar ..... H04H 60/33 381/59

* cited by examiner

*Primary Examiner* — Jakieda Jackson
(74) *Attorney, Agent, or Firm* — Kristine Elizabeth Matthews

(57) ABSTRACT

Aspects of the present invention relate to systems, methods and apparatus for identifying a reference audio content in an audio stream.

8 Claims, 7 Drawing Sheets

METHODS AND SYSTEMS FOR DECREASING LATENCY OF CONTENT RECOGNITION

FIELD OF THE INVENTION

Embodiments of the present invention relate generally to methods and systems for identifying specific audio content in an audio stream and, in particular, to methods and systems for decreasing latency of content recognition.

BACKGROUND

Systems exist in the art for recognizing audio content by comparing received audio content with one or more reference examples of audio content and looking for a match between the received content and the reference audio content. One common method for accomplishing this task is the use of audio fingerprints, which are algorithmic signatures computed from received or reference audio content. In such fingerprint recognition systems, fingerprints generated from reference audio content are stored at a location. When received audio content is to be analyzed, a series of audio fingerprints is generated from successive samples of the received audio content and compared with the stored reference fingerprints. When a sufficiently robust similarity is found between one or more fingerprints generated from received audio content and one or more fingerprints generated from reference audio content, a match is declared. A number of systems have been defined for generating and manipulating such audio fingerprints, including, for example, U.S. Pat. No. 6,968,337 B2.

When audio content is received in sequential fashion, for example, when sampling ambient audio content or when receiving a broadcast audio stream, fingerprint recognition systems exhibit a latency between the commencement of the reception of a body of audio content and the declaration of a match to the received audio content with a reference audio content. This latency arises, in part, because of the finite duration of the sampling window used to gather audio samples from either a received audio source or a reference audio source when calculating an algorithmic fingerprint.

Methods and systems for reducing the latency for recognizing received audio content when using a fingerprint recognition system may be desired.

SUMMARY

Some embodiments of the present invention relate to methods, systems and apparatus for receiving at least one reference audio content, generating modified reference audio content by prepending selected audio content to said reference audio content, generating at least one modified reference fingerprint from the modified reference audio content, receiving an audio stream and sampling the audio stream, generating at least one fingerprint from the samples of the audio stream, comparing the at least one fingerprint generated from the samples of the audio stream with at least one modified reference fingerprint, determining that the fingerprints match at least in part and thereby identifying that the audio stream contains the reference audio content.

One aspect of the present invention further teaches choosing selected audio content so as to not produce a fingerprint match with any received reference audio content.

Yet another aspect of the present invention further teaches choosing selected audio content to be a fixed duration of pink noise.

Yet another aspect of the present invention further teaches choosing selected audio content to be a fixed duration of low-frequency noise.

Yet another aspect of the present invention teaches a system for receiving an audio stream and identifying a portion of the audio stream, the system comprising a reference-fingerprint generator module configured to receive a reference audio content, to modify the reference audio content by prepending selected audio content to the reference audio content and to generate at least one modified reference fingerprint from the modified reference audio content; a database module configured to store said modified reference fingerprint; a sampler module configured to receive an audio stream and extract samples therefrom; a buffer module configured to store samples of the audio stream; a fingerprint generator module configured to generate at least one sample fingerprint from the stored samples of said audio stream; and a fingerprint comparator module configured to compare the at least one modified reference fingerprint with the at least one sample fingerprint and detect a match between at least a portion of the two fingerprints, thereby identifying that the reference audio content occurs in said audio stream.

Yet another aspect of the present invention teaches a method for receiving at least one reference audio content, generating modified reference audio content by prepending selected audio content to the reference audio content, generating at least one modified reference fingerprint from the modified reference audio content, and using said modified reference fingerprint to identify audio content.

Yet another aspect of the present invention teaches a method for receiving at least one reference audio content, generating modified reference audio content by prepending selected audio content to the reference audio content, generating at least one modified reference fingerprint from the modified reference audio content, storing said at least one modified reference fingerprint in a fingerprint database, receiving a broadcast stream comprising audio content, generating at least one sample fingerprint from the audio content of the broadcast stream, forwarding said at least one sample fingerprint to a fingerprint recognition server, comparing said at least one sample fingerprint with the at least modified reference fingerprint, and upon finding a match between said sample fingerprint and the modified reference fingerprint, performing an action based upon the identity of the reference audio content.

Some embodiments of the present invention relate to methods and systems for generating a reference fingerprint associated with a reference audio content. In some embodiments of the present invention, a reference audio content may be received. A selected audio content may be prepended to the reference audio content, thereby generating a modified reference audio content. A reference fingerprint may be generated from the modified reference audio content using an analysis window comprising a portion of the prepended, selected audio content.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF EXEMPLARY EMBODIMENTS

Figure 1:
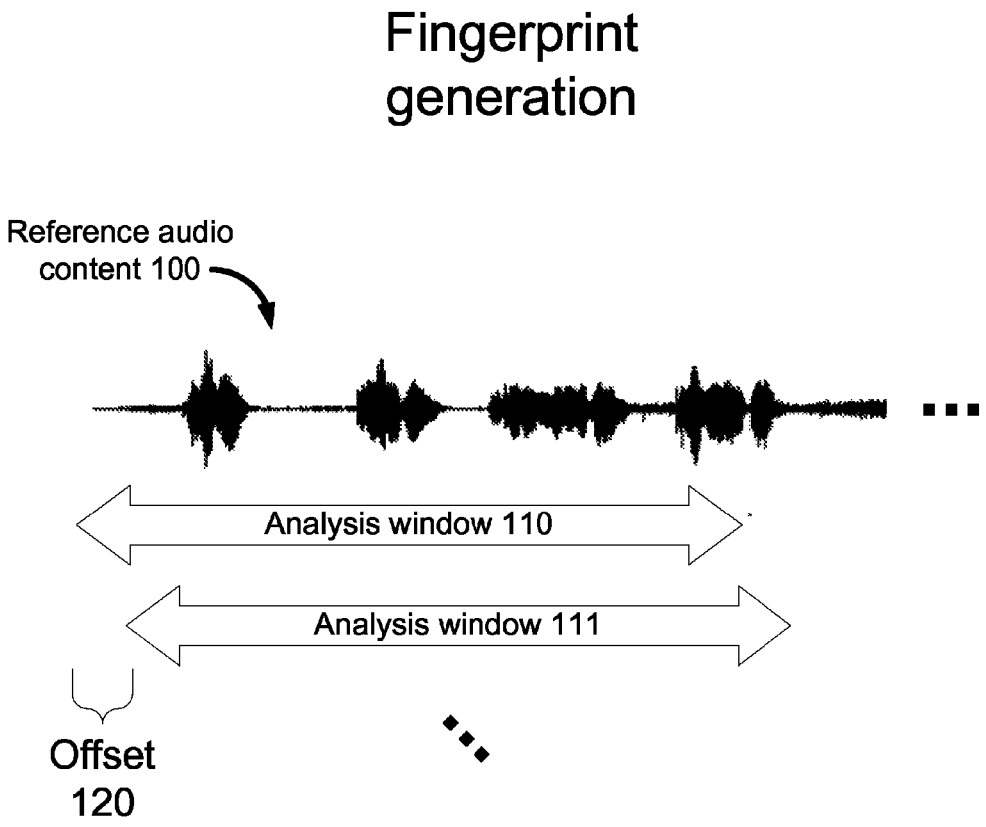
Prior Art FIG. 1
FIG. 1 depicts a prior art method for generating fingerprints from auditory reference content.

Embodiments of the present invention will be best understood by reference to the drawings, wherein like parts are designated by like numerals throughout. The figures listed above are expressly incorporated as part of this detailed description.

An artistic work may be the realization of an intent of an artist. In some means of artistic expression, for example, a painting and a sculpture, an artistic work is a physical object with permanence, whereas in other means of artistic expression, for example, dance, an artistic work may be an ephemeral entity existing only during the process of performance. However, in the latter case, an artistic work may be captured into a physical form through means of a recording technology. The artistic work may then be rendered from the recorded version of the work, but a reproduction of the work will necessarily differ from the original performance. For example, in dance, the recording of the artistic work will necessarily be limited to a capture of one, or a few, specific views of the performance, so that the reproduction of those limited views will differ from the original performance of the artistic work.

A creator of an auditory artistic work may create the artistic work by defining a sequence of instructions that specify the nature of the sounds to be created comprising the work. For example, an artist may create a musical score specifying the pitch, timbre, timing, volume, vibrato, and other acoustic attributes of the sounds to be created by one or more instruments and/or voices during the performance of the artistic work. In such a case, the musical score constitutes one representation of the auditory artistic work. Each performance of the musical score according to the artist's instructions will vary in subtle or significant ways from each other performance of the musical score, but each such performance may represent the same auditory artistic work. A performance of a musical score may be recorded for later reproduction.

Alternatively, the artist may perform the auditory artistic work by creating a sequence of sounds alone or in combination with other auditory performers, whereby the sequence of sounds per se constitutes the auditory artistic work. The performance of an auditory artistic work may be recorded for later reproduction.

The reproduction of a recording of an auditory artistic work will differ in subtle or significant detail from the original performance owing to alterations in the manner in which the sound waves are generated or transmitted from the original recording of the work. Examples of such alterations include frequency limitations in the recording apparatus, variations in the speed of the recording apparatus, noise introduced during the recording process and other factors which may effectuate a deviation from the original performance. Similarly, each reproduction of a recording of an auditory artistic work will differ in subtle or significant detail from each other reproduction of the same recording, owing for example to variations in the speed of the playback apparatus, frequency limitations in the reproduction apparatus, noise introduced during the playback process and other factors which may effectuate a deviation from another reproduction of the same recording.

Accordingly, as used herein, the term "audio work" refers to a recording of a series of sound waves constituting a performance of an auditory artistic work. The recording may be stored in analog form, for example, as grooves on a vinyl record and other analog forms, or in digital form, for example, as a series of numerical values stored in a disk file on computer and other digital forms. A recording may be copied one, or more, times, and the contents of a recording or of a copy of a recording may be reproduced in the form of sound waves one, or more, times.

As used herein, the term "audio content" refers to a presentation of an audio work by the conveyance of all or a portion of the recorded sound waves constituting the audio work. Audio content is "associated" with the corresponding recorded audio work. The conveyance of audio content may be by digital transmission of the original content of a digital recording of an audio work. Alternatively, the conveyance may be by digital transmission of a modified version of the original digital content of a digital recording of an audio work, for example, a compressed, transcoded and other digitally modified version of the original digital content. Alternatively, the conveyance may be as an analog representation of the content of a digital or analog recording of an audio work, for example, as a frequency modulated radio frequency electromagnetic wave and other analog representations. When audio content is conveyed by digital transmission of the original content of a digital recording of an audio work, each presentation of the audio content may be identical with each other presentation of the audio content. In general however, each presentation of audio content from an audio work will differ in subtle or significant degree from each other presentation of audio content of the same audio work. A first audio content and a second audio content may be substantially identical and considered to match when, to a human observer, the first audio content and the second audio content may be perceived as identical, otherwise cannot be differentiated, or are recognizable as the same portion of the same audio work. The first audio content and the second audio content may not be physically identical due to, for example, noise, filtering, frequency shifting and other processes that may cause two audio representations of the same audio work to differ, but may nonetheless be considered to match.

As used herein, the phrase "audio-video content" refers to a media item which comprises audio content and which may additionally comprise video content.

As used herein, the term "audio stream" refers to one or more audio contents conveyed in an analog or a digital form.

As used herein, the term "fingerprint" refers to a value or set of values computed as a condensed mathematical representation of the information contained within some set of numerical samples of a quantity. An "audio fingerprint" is computed from a set of digital samples of audio content, the set comprising sequential values of the audio content sampled over a finite sampling window, which may be referred to as an analysis window. The samples used to compute an audio fingerprint may come from a previously identified "reference" audio content, or from a newly-received, but as-yet unidentified, audio content. Samples may be retrieved from a storage medium or may be acquired in real time by sampling ambient sound waves or by sequential access to streaming analog or digital audio content. Reference fingerprints may be stored in a reference fingerprint store for later access. Two audio fingerprints may be considered to "match", for example, when for a required subset of the values comprising a fingerprint the magnitude of the difference between a value of the first audio fingerprint and a value for the second audio fingerprint is less than a threshold difference for the value.

As used herein, the term "white noise" refers to randomized audio content configured such that the power spectral density of the content is constant. Ideally, white noise is random in the amplitude, phase and frequency of its constituent components.

As used herein, the term "pink noise" refers to randomized audio content configured such that the power spectral density of the content is inversely proportional to the frequency of the signal. Pink noise has less power at higher frequency than white noise, but is similarly random in the amplitude, phase and frequency of its constituent components.

It will be readily understood that the components of the present invention, as generally described and illustrated in the figures herein, could be arranged and designed in a wide variety of different configurations. Thus, the following more detailed description of the embodiments of the methods, systems and apparatus of the present invention is not intended to limit the scope of the invention, but it is merely representative of the presently preferred embodiments of the invention.

Elements of embodiments of the present invention may be embodied in hardware, firmware and/or a non-transitory computer program product comprising a computer-readable storage medium having instructions stored thereon/in which may be used to program a computing system. While exemplary embodiments revealed herein may only describe one of these forms, it is to be understood that one skilled in the art would be able to effectuate these elements in any of these forms while resting within the scope of the present invention.

Although the charts and diagrams in the figures may show a specific order of execution, it is understood that the order of execution may differ from that which is depicted. For example, the order of execution of the blocks may be changed relative to the shown order. Also, as a further example, two or more blocks shown in succession in a figure may be executed concurrently, or with partial concurrence. It is understood by those with ordinary skill in the art that a non-transitory computer program product comprising a computer-readable storage medium having instructions stored thereon/in which may be used to program a computing system, hardware and/or firmware may be created by one of ordinary skill in the art to carry out the various logical functions described herein.

Some embodiments of the present invention may comprise a computer program product comprising a computer-readable storage medium having instructions stored thereon/in which may be used to program a computing system to perform any of the features and methods described herein. Exemplary computer-readable storage media may include, but are not limited to, flash memory devices, disk storage media, for example, floppy disks, optical disks, magneto-optical disks, Digital Versatile Discs (DVDs), Compact Discs (CDs), micro-drives and other disk storage media, Read-Only Memory (ROMs), Programmable Read-Only Memory (PROMs), Erasable Programmable Read-Only Memory (EPROMS), Electrically Erasable Programmable Read-Only Memory (EEPROMs), Random-Access Memory (RAMs), Video Random-Access Memory (VRAMs), Dynamic Random-Access Memory (DRAMs) and any type of media or device suitable for storing instructions and/or data.

By way of illustration of the prior art, FIG. 1 depicts, in part, an exemplary prior art method for generating reference fingerprints from a reference audio content 100. Reference audio content 100 is depicted as a waveform, which represents the audio sound level as time advances from left to right. In this exemplary prior art fingerprint system, a series of analysis windows (two shown) 110, 111 is used to generate reference fingerprints which are then stored in a reference fingerprint database. The audio samples comprising each analysis window are supplied to a fingerprint generation algorithm which computes an algorithmic fingerprint for storage in a reference fingerprint database. In this example, each analysis window, for example, analysis window 111, is displaced from the previous analysis window, for example, analysis window 110, by an offset 120. The reference audio content 100 may be supplied as an audio stream provided at a fixed or variable rate, in which case, the audio content is available for fingerprint generation sequentially in time, with the audio samples comprising analysis window 110 being available first, followed by the audio samples comprising analysis window 111, and so forth, each analysis window representing a portion of reference audio content 100 received over some period of time. Alternatively the audio content may be supplied on a storage medium, in which case the analysis windows are extracted from the stored content in any desired order, each analysis window comprising a set of contiguous audio samples representing some fragment of the total stored audio content.

Figure 2:
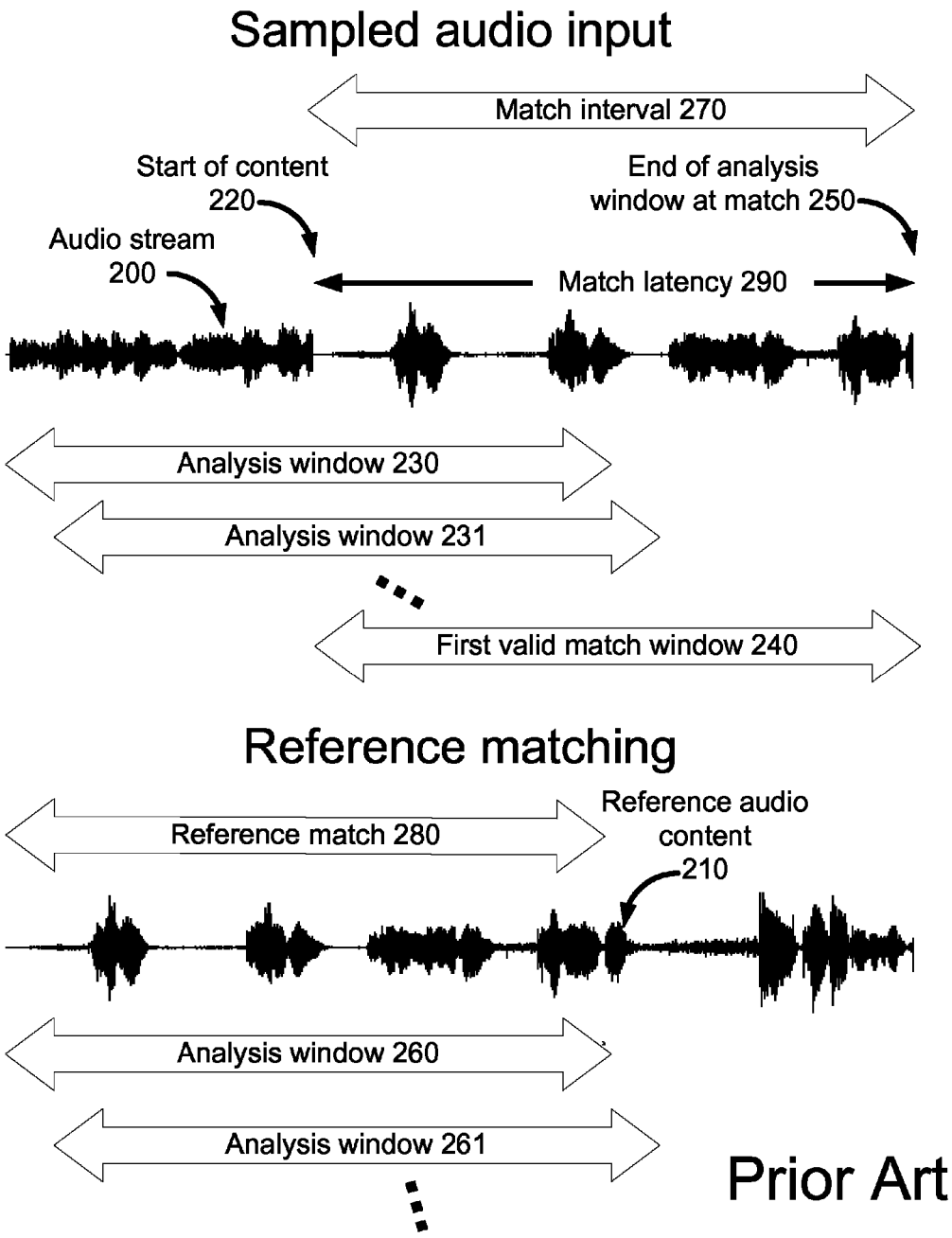
Prior Art FIG. 2
FIG. 2 depicts a prior art method for using fingerprint matching to identify sampled audio input.

By way of further illustration of the prior art, FIG. 2 depicts in part an exemplary prior art method for using reference fingerprints to identify audio content. An audio stream 200 is sampled, and at periodic intervals a fingerprint is computed from the set of audio samples in an analysis window (two shown) 230, 231. The fingerprints from the analysis window 230, 231 are compared with fingerprints generated from a reference audio content 210 using similar analysis windows 260, 261. At a certain point in the audio stream 200, a fingerprint generated from an analysis window 240 is matched to a reference fingerprint generated from analysis window 260, the first valid match window 240 containing samples from a match interval 270 corresponding to a reference match 280. Since the samples comprising first valid match window 240 span the interval from the start of content 220 to the end of the sampling window 250, the match latency 290 is equal to the duration of the match interval 270. This latency occurs, in part, because in prior art methods, salient features of the audio content within a match interval 270, for example, volume, pitch, timber of segments of the sampling window and other features, or the rates of changes of such features across the sampling window, may be required to match corresponding features in a reference window 280 with regard to their position within the analysis window. Because of this requirement for positional correlation between the acoustic features of the sampled-audio-input analysis window 230, 231, 240 and the reference analysis window 260, 261, the minimum latency to detect a match between sampled audio input and reference audio input is substantially equal to the duration of the analysis window.

Because prior art audio recognition systems are intended to be robust against various environmental factors, for example, ambient noise, interruptions in content, distortions in sampled input and other environment factors, prior art systems may signal a match when only a portion of the content of an analysis window matches the corresponding portion of a reference analysis window. The inventor of the present invention realized that this capability could be exploited to advantage in developing the current inventive method and system which is described in detail below.

Figure 3:
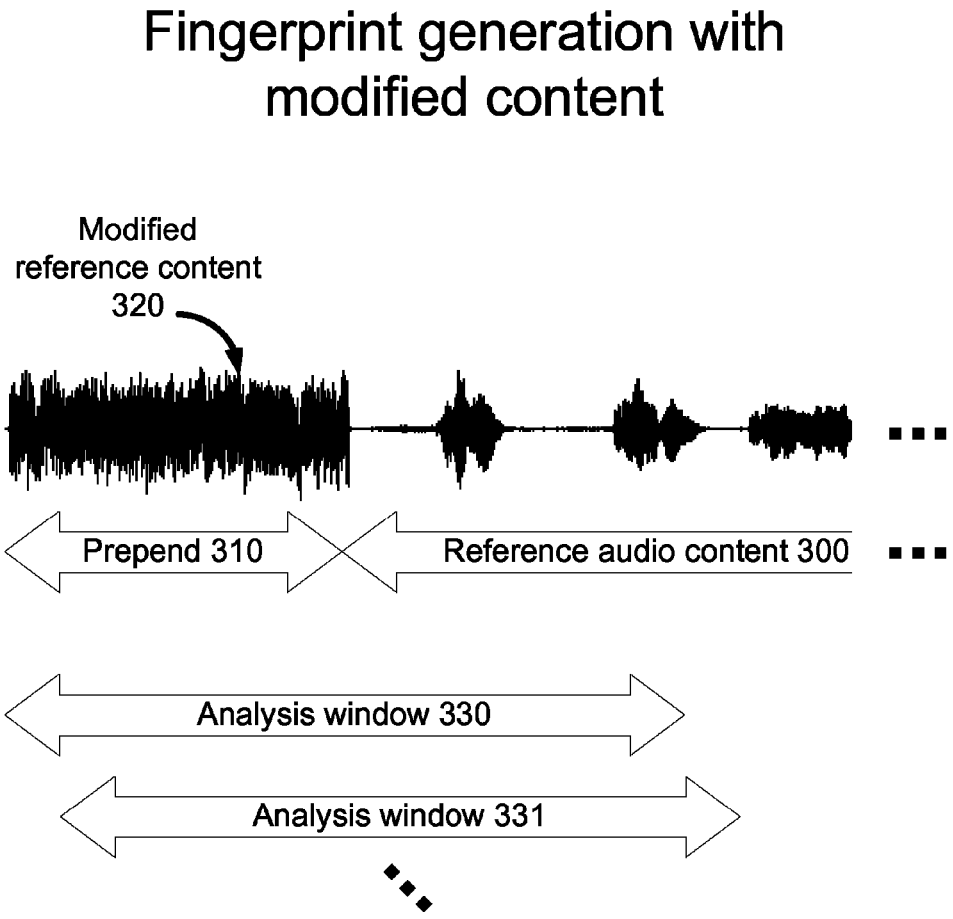
FIG. 3 depicts an aspect of the present invention practiced for the generation of modified reference audio content and the generation of fingerprints therefrom.

FIG. 3 depicts an aspect of the present invention. Prior to computing reference fingerprints from reference audio content 300, additional content 310 may be prepended to reference audio content 300 to product modified reference audio content 320. The modified reference audio content 320 may be analyzed with successive analysis windows (two shown) 330, 331 to produce a set of modified reference fingerprints that may be, in some embodiments of the present invention, stored in a fingerprint database. At least one analysis window may comprise the prepended, additional content. Advantageously, additional content 310 may be selected such that acoustic attributes of additional content 310 do not influence a match detected by a fingerprint-match system when comparing a modified reference fingerprint with another fingerprint. For example, if a fingerprint-match system relies on a comparison of the primary frequency components within an analysis window when comparing fingerprints, additional content 310, for example, comprising pink noise, may result in no primary frequency component being recognized for the portion of the analysis window occupied by additional component 310.

Figure 4:
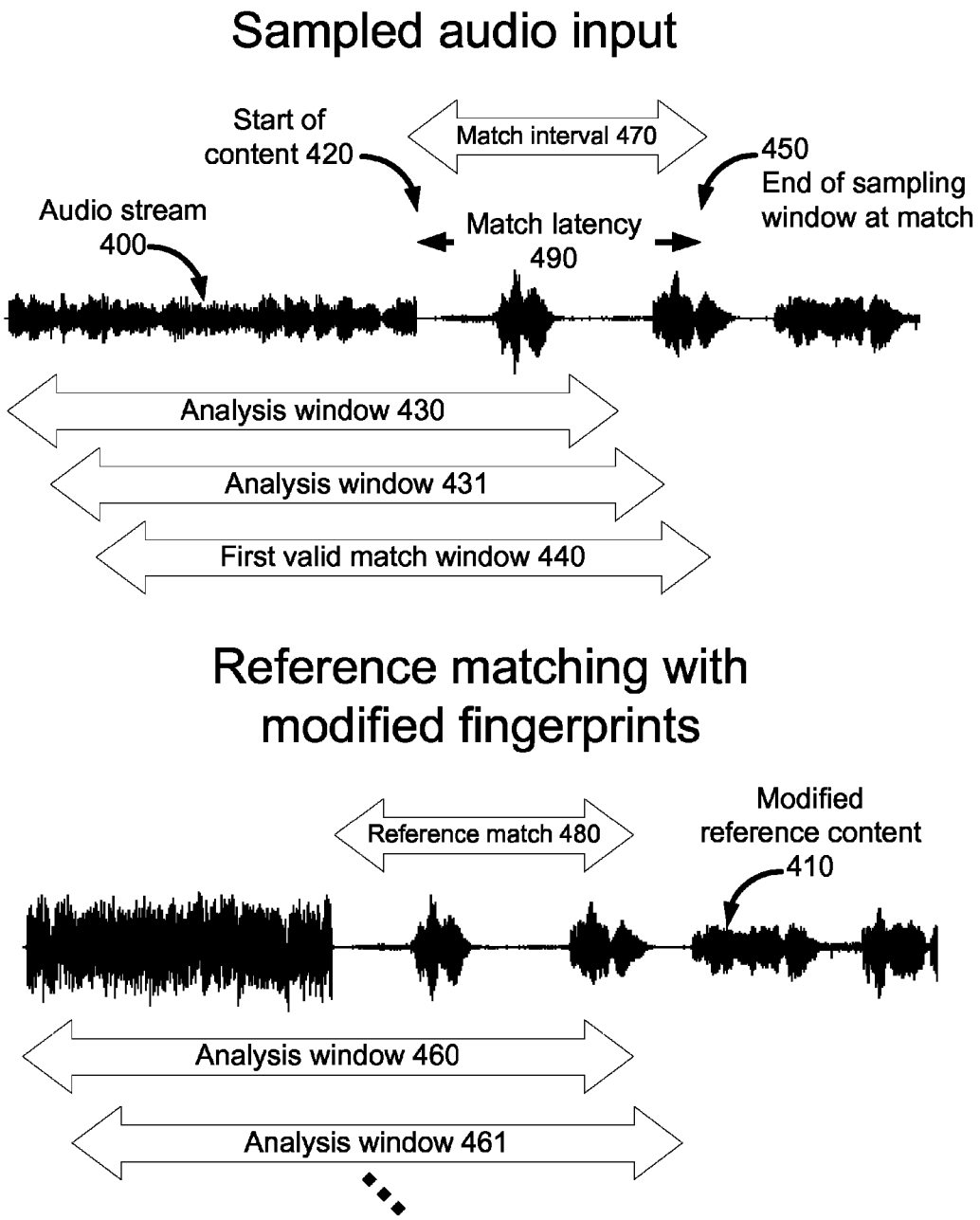
FIG. 4 depicts an aspect of the present invention practiced for the identification of sampled audio input.

Some embodiments of the present invention may use these modified reference fingerprints as illustrated, in part, in FIG. 4. When an audio stream 400 is analyzed with the inventive method and system, a series of analysis windows (three shown) 430, 431, 440 may be used to compute a series of fingerprints which may be compared with modified reference fingerprints computed from analysis windows (two shown) 460, 461 of a modified reference audio content 410. In the inventive system, a first match window 440 may produce a fingerprint that matches the modified reference fingerprint computed from analysis window 460, since the content in the match interval 470 at the latter portion of a first valid match window 440 may match the reference match 480 in the corresponding latter portion of an analysis window 460. The end 450 of a first valid match window 440 occurs at a match latency 490 which is determined by the duration of the match interval 470 rather than by the duration of an analysis window 430, 431, 440, 460, 461. Because the duration of the match interval 470 is less than the duration of the analysis window 430, 431, 440, 460, 461, the match latency 490 is shorter than the match latency 290 in prior art systems.

Figure 5:
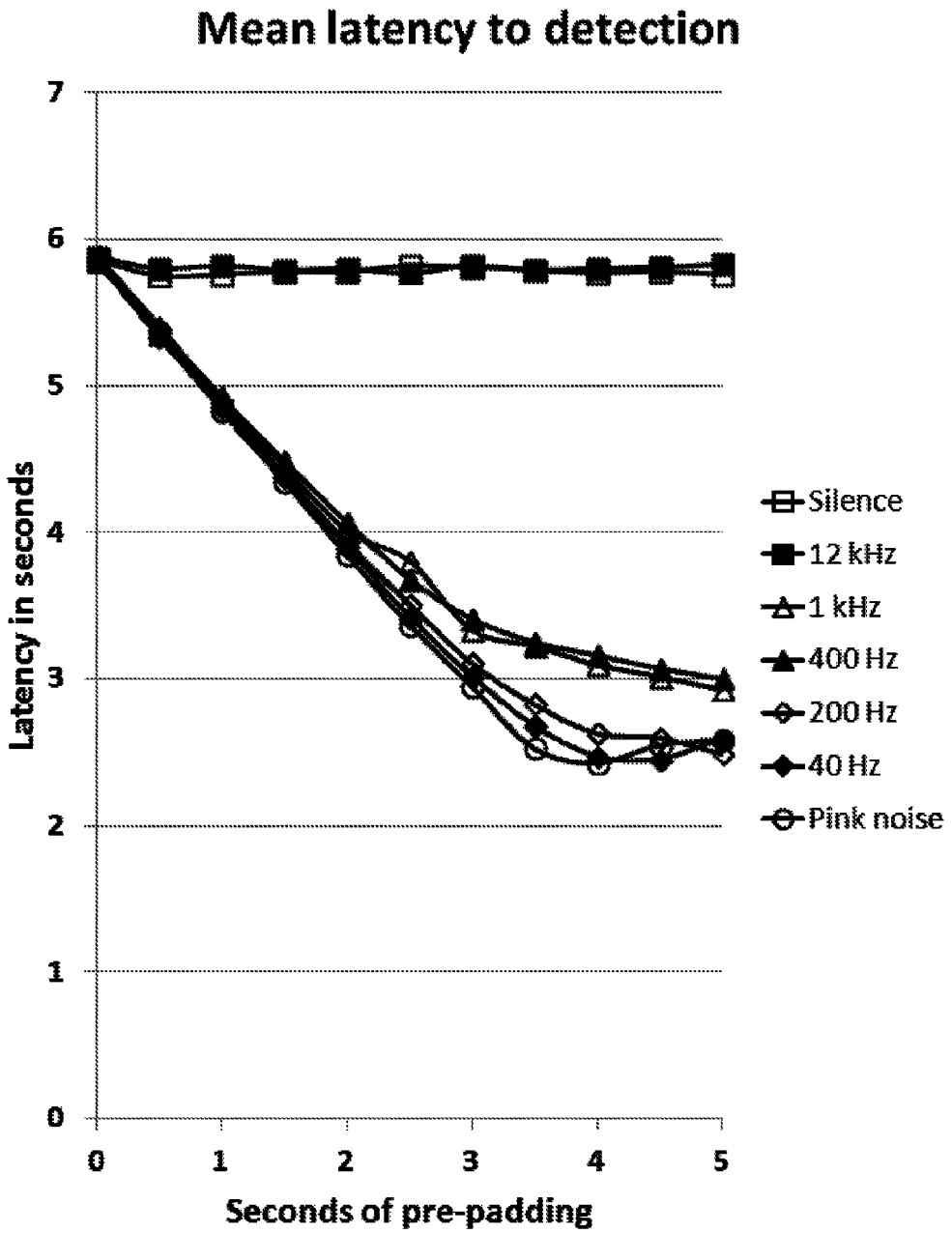
FIG. 5 depicts the effect of various durations of various types of audio content on the behavior of an exemplary implementation of the present invention.

Some embodiments of the present invention may rely on a behavior of prior art systems in matching a portion of a fingerprint generated from an analysis window in unknown audio with a corresponding portion of a fingerprint generated from an analysis window in reference audio. In some embodiments of the present invention, to avoid a false identification of content, the additional content 310 prepended to reference audio content 300 when generating modified reference audio content 320 may be chosen so as to not produce a spurious match with reference audio content. In some embodiments of the present invention, the duration of the additional content 310 may be selected to optimize a decrease in recognition latency. FIG. 5 depicts exemplary types of additional content 310 that may be selected in some embodiments of the present invention. FIG. 5 summarizes the results of a number of experiments using one prior art system for fingerprint recognition of audio content using modified reference audio content according to embodiments of the present invention. A variety of types of additional content 310 were utilized at a variety of durations, with the resulting latency shown graphed in FIG. 5. Employing this exemplary prior art fingerprint match system, using pink noise or low-frequency audio content (40 Hz or 200 Hz constant tone) for the prepended content in generating a modified reference audio content according to embodiments of the present invention yielded optimal results with pre-padding durations of approximately 4 seconds. Use of intermediate-frequency audio content (400 Hz or 1 kHz constant tone) for the prepended content in generating a modified reference audio content according to embodiments of the present invention yielded less improvement of recognition latency, while use of silence or high-frequency audio content (12 kHz constant tone) for the prepended content in generating a modified reference audio content according to embodiments of the present invention did not decrease recognition latency. For the exemplary prior art fingerprint recognition system employed for these tests, pink noise of 4 second duration may be an optimal choice for additional content 310 to be prepended to reference audio content 300 to generate modified reference audio content 320. Other content choices such as white noise; amplitude-modulated constant tone; frequency-modulated constant amplitude tone; amplitude- and frequency-modulated tonal content; or other types of audio content may be suitable for use as additional content 310 in alternative embodiments of the present invention, provided that the additional content 310 allows the fingerprint recognition system to report a true partial match of modified reference audio content 320 with unknown audio content 400 without resulting in false matches to other modified reference audio content.

Figure 6:
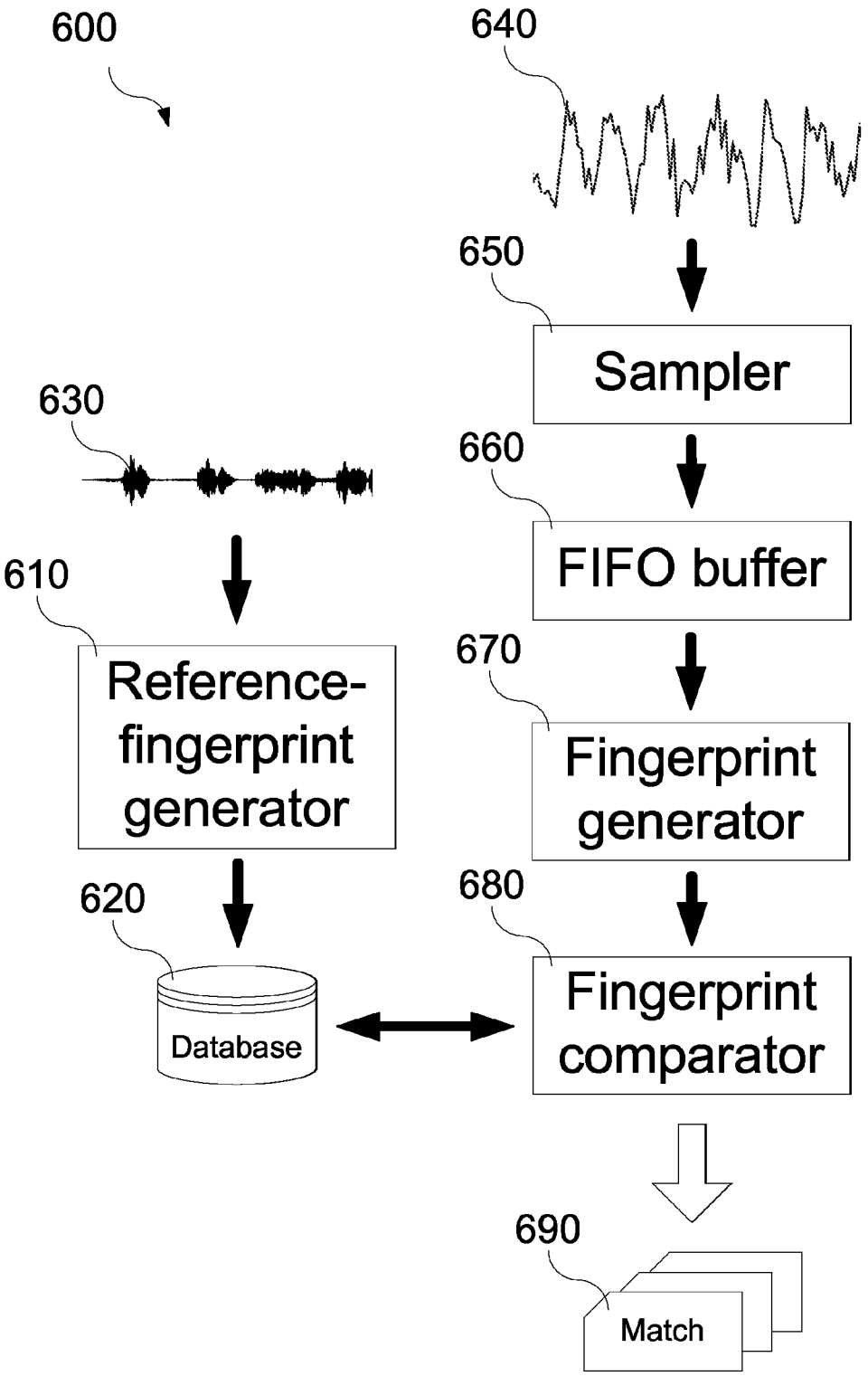
FIG. 6 depicts components of an exemplary system configured to practice an aspect of the present invention.

FIG. 6 depicts elements of an exemplary system 600 configured to perform an aspect of the present invention. Reference-fingerprint generator 610 may be communicatively coupled with database 620. Reference-fingerprint generator 610 may receive reference audio content 630 and may prepend additional content 310 to create a modified reference audio content. Reference-fingerprint generator 610 may generate a modified fingerprint from the modified reference audio content and may store the fingerprints in fingerprint database 620. When an audio stream 640 is to be analyzed, a sampler 650 may sample the audio stream 640 and may forward the sample to a First-In-First-Out (FIFO) buffer 660. A fingerprint generator 670 may extract a set of samples from FIFO buffer 660 and may compute a fingerprint which may be forwarded to a fingerprint comparator 680. Fingerprint comparator 680 may compare the newly-generated sample fingerprint with a modified reference fingerprint stored in fingerprint database 630. When a match is found between the sample fingerprint and a modified reference fingerprint, the match 690 may be reported by the system.

In some embodiments of the present invention, when system 600 reports a match 690, the identity of the reference audio content 630 used to generate the corresponding modified reference fingerprint may be signaled to an external system which may perform an action based upon the detection of the reference audio content. Co-pending U.S. patent application, application Ser. No. 13/874,268, entitled "METHODS AND SYSTEMS FOR DISTRIBUTING INTERACTIVE CONTENT" and filed on Apr. 30, 2013 describes an exemplary system configured to perform an action based upon the detection of a reference audio content. Application Ser. No. 13/874,268 is hereby incorporated by reference herein in its entirety.

The reference audio content 630 and the audio stream 640 may be from a broadcast stream of indefinite length; may be an audio content stored in permanent form on a physical medium, for example, a compact disc, a DVD, a blu-ray disc, a magnetic memory, a solid state memory and other storage medium; may be ambient sound sampled by a microphone; or may be from some other permanent or evanescent source. In some embodiments of the present invention, the sampler 650, the FIFO buffer 660 and the fingerprint generator 670 may be implemented as a single unit. In alternative embodiments, these elements may be implemented as separate units. In some embodiments of the present invention, the operation of the components of system 600 may be performed by hardware. In alternative embodiments of the present invention, the operation of the components of system 600 may be performed by software. In yet alternative embodiments of the present invention, the operation of system 600 may be performed by a combination of hardware and software. In some embodiments of the present invention, the operations may be performed by a single machine. In alternative embodiments of the present invention, the operations may be performed by multiple machines. In some embodiments of the present invention, the operations may be performed at a single location. In alternative embodiments of the present invention, the operations may be performed at multiple locations. All such variations described herein for illustration and other such variations recognized by a person having ordinary skill in the art rest within the scope of the present invention.

Figure 7:
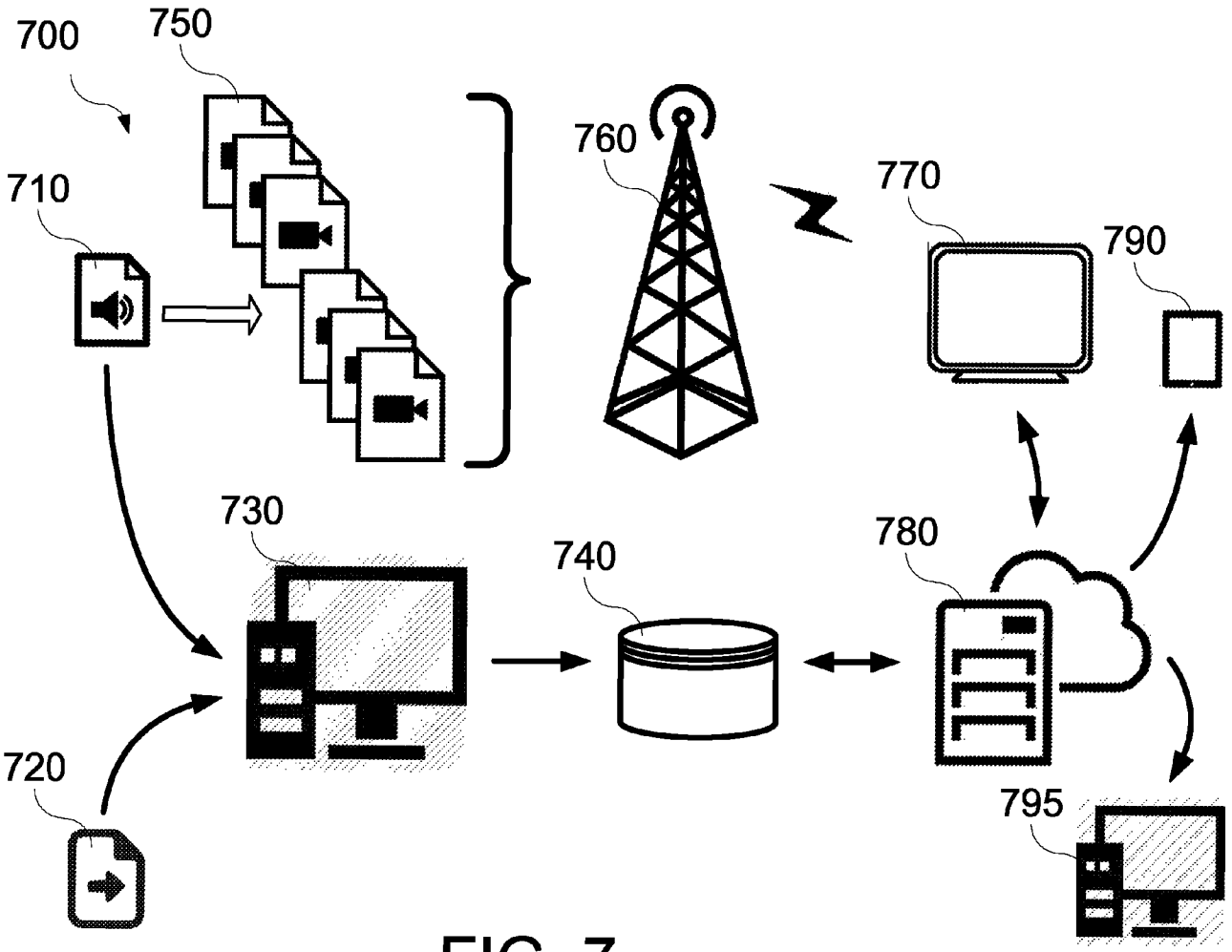
FIG. 7 depicts components of an exemplary system configured to practice an aspect of the present invention.

FIG. 7 depicts elements of an exemplary system 700 configured to perform an aspect of the present invention. An item of audio-video content 710 may be incorporated into a broadcast stream, and the content of the broadcast stream may be analyzed and the presence of audio-video content 710 may be detected; when the presence of content 710 is detected, secondary content may be provided in response to the detection. Prior to the broadcast of item 710, the content of item 710 may be associated with secondary content 720. Secondary content 720 may be textual content describing item 710. Alternatively, secondary content 720 may be visual images associated with item 710. As yet another alternative, secondary content 720 may be audio-video content related to item 710. As yet another alternative, secondary content 720 may be the address or content of a web page providing additional information related to item 710. As yet another alternative, secondary content 720 may be an interactive application executable to provide additional information or behavior related to item 710. As yet a further alternative, secondary content 720 may be any form of data that provides information, images or behavior related to item 710.

Audio-video content item 710 and secondary content 720 may be provided to a fingerprint processor 730 which may perform the actions of fingerprint generation component 610 to generate reference fingerprints from the audio content of item 710 in accordance with the present invention. Fingerprint processor 730 further may store the generated reference fingerprints and the associated secondary content 720 in database 740.

Audio-video content item 710 may be inserted into a sequence 750 of items of audio-video content and the resulting stream of audio-video content may be distributed by a distribution component 760. The distribution may be accomplished by means of terrestrial radio-frequency broadcast; through a satellite distribution system; through a cable television distribution system; by means of Internet Protocol (IP) distribution, or by other means known in the art.

A receiver 770 may receive the audio-video broadcast content and may generate at least one fingerprint from the audio portion of the content in accordance with the present invention. The generated fingerprint may be forwarded to a fingerprint recognition server 780 for comparison with reference fingerprints stored in database 740. When fingerprint server 780 finds an appropriate match with a reference fingerprint, fingerprint recognition server 780 may provide secondary content 720 associated with the reference fingerprint to receiver 770. Receiver 770 may utilize secondary content 720 to augment the display of audio-video broadcast content. In an exemplary embodiment of the present invention, receiver 770 may display textual content contained in secondary content 720. In an alternative exemplary embodiment of the present invention, receiver 770 may display image content contained in secondary content 720. In yet another exemplary embodiment of the present invention, receiver 770 may display audio-video content contained in secondary content 720. In yet another exemplary embodiment of the present invention, receiver 770 may display web content referenced by or contained in secondary content 720. In yet another exemplary embodiment of the present invention, receiver 770 may execute an interactive application contained in secondary content 720.

In an alternative embodiment of the present invention, secondary content 720 may be provided to companion device 790 for display or interactivity rather than being provided to receiver 770.

In yet another alternative embodiment of the present invention, secondary content 720 could be provided to a secondary content processor 795. Upon receiving secondary content 720 from fingerprint recognition server 780, secondary content processor 795 may perform an action based on secondary content 720. As an example, an action performed by secondary content processor 795 may be to aggregate a count of recognition events for secondary content 720. As an alternative example, an action performed by secondary content processor 795 may be to modify the contents of a web page. As a yet further alternative example, an action performed by secondary content processor 795 may be to insert secondary content 720 associated with the identifier reference audio content 710 into a broadcast stream.

Audio content 710 may be stored in permanent form on a physical medium such as a compact disc, a DVD, a blu-ray disc, a magnetic memory, a solid state memory, or other storage medium; or may be from some other permanent or evanescent source. In some embodiments of the present invention, fingerprint processor 730, database 740 and fingerprint recognition server 780 may be implemented as a single unit. In alternative embodiments of the present invention, fingerprint processor 730, database 740 and fingerprint recognition server 780 may be implemented as separate units. In some embodiments of the present invention, the operations of fingerprint processor 730, database 740 and fingerprint recognition server 780 may be performed by hardware; in alternative embodiments, by software; and in yet alternative embodiments by a combination of hardware and software. In some embodiments of the present invention, the operations of fingerprint processor 730, database 740 and fingerprint recognition server 780 may be performed by a single machine; and in alternative embodiments, by multiple machines. In some embodiments of the present invention, the operations of fingerprint processor 730, database 740 and fingerprint recognition server 780 may be performed at a single location; and in alternative embodiments, at multiple locations.

All such variations described herein for illustration and other such variations recognized by a person having ordinary skill in the art rest within the scope of the present invention.

Communication between broadcast component 760 and receiver 770 may be accomplished by any means known to the art, and may be accomplished by a wired or wireless communication path, or by a combination of wired and wireless communication paths. Communication between receiver 770 and fingerprint recognition server 780, and between fingerprint recognition server 780 and companion device 790, may be accomplished by any means known to the art, and may be by a wired or wireless communication path, or by a combination of wired and wireless communication paths. All such variations rest within the scope of the current invention.

The terms and expressions which have been employed in the foregoing specification are used therein as terms of description and not of limitation, and there is no intention in the use of such terms and expressions of excluding equivalence of the features shown and described or portions thereof, it being recognized that the scope of the invention is defined and limited only by the claims which follow.

What is claimed is:

1. A method for reducing latency in identification of an audio work in an audio stream received in an audio recognition system, the method comprising:

receiving, in a reference-fingerprint generator, a reference audio content associated with an audio work;

generating, in the reference-fingerprint generator, a modified reference audio content by prepending a selected audio content to the reference audio content;

computing, in the reference-fingerprint generator, at least one modified-reference fingerprint from the modified reference audio content using an analysis window comprising a portion of the prepended, selected audio content;

storing, in a database communicatively coupled to the reference-fingerprint generator, the at least one modified-reference fingerprint;

receiving, in an audio recognition system, an audio stream;

sampling, in the audio recognition system, the audio stream in real time;

computing, in the audio recognition system, at least one fingerprint from the samples of the audio stream;

comparing, in the audio recognition system, the at least one fingerprint generated from the samples of the audio stream with the at least one modified-reference fingerprint stored in the database; and when a first fingerprint from the at least one fingerprint generated from the samples of the audio stream substantially matches a second fingerprint from the at least one modified-reference fingerprint, identifying that the audio stream comprises the audio work.

2. The method of claim 1, wherein the selected audio content does not produce a fingerprint match with the reference audio content.

3. The method of claim 1, wherein the selected audio content comprises a fixed duration of a pink noise.

4. The method of claim 1, wherein the selected audio content comprises a fixed duration of a low-frequency tone.

5. An audio recognition system for identifying an audio work in a received audio stream, the system comprising:

a reference-fingerprint generator module configured to receive a reference audio content associated with an audio work, to modify the reference audio content by prepending a selected audio content to the reference audio content and to generate at least one modified-reference fingerprint from the modified reference audio content using an analysis window comprising a portion of the prepended, selected audio content;

a database module configured to store the at least one modified-reference fingerprint;

a sampler module configured to receive an audio stream and to extract samples, in real time, therefrom;

a buffer module configured to store the extracted samples of the audio stream;

a fingerprint generator module configured to generate at least one sample fingerprint from the stored samples of said audio stream; and a fingerprint comparator module configured to compare two fingerprint, wherein one of the two fingerprint is a fingerprint from the at least one modified-reference fingerprint and the other of the two fingerprints is a fingerprint from the at least one sample fingerprint and to detect a match between at least a portion of said two fingerprints, thereby identifying that the audio stream comprises the audio work.

6. The system of claim 5, wherein the selected audio content does not produce a fingerprint match with any reference audio content.

7. The system of claim 5, wherein the selected audio content comprises a fixed duration of a pink noise.

8. The system of claim 5, wherein the selected audio content comprises a fixed duration of a low-frequency tone.

* * * * *